US006119911A

United States Patent [19]

Funk et al.

[11] Patent Number: 6,119,911

[45] Date of Patent: Sep. 19, 2000

[54] STAPLING DEVICE

[75] Inventors: Helmut Funk, Remshalden; Joachim Buck, Laichingen; Juergen Ries, Ostfildern; Gert Scheufler, Winnenden, all of Germany

[73] Assignee: Eastman Kodak Company, Rochester, N.Y.

[21] Appl. No.: 09/186,826

[22] Filed: Nov. 5, 1998

Related U.S. Application Data

[63] Continuation-in-part of application No. 09/044,191, Mar. 19, 1998.

[30] Foreign Application Priority Data

Mar. 27, 1997 [DE] Germany ..... 197 12 876
Dec. 17, 1997 [DE] Germany ..... 197 56 119

[51] Int. Cl.[7] ..... B27F 07/21; B27F 07/28

[52] U.S. Cl. ..... 227/88; 227/5; 227/84; 227/89; 227/90; 227/97

[58] Field of Search ..... 227/88, 89, 90, 227/91, 97, 5, 7, 84; 270/37, 580.8, 580.9

[56] References Cited

U.S. PATENT DOCUMENTS

| | | | |
|---|---|---|---|
| 1,692,017 | 11/1928 | Wolf | 227/88 |
| 2,554,691 | 5/1951 | Zeruneith | 227/90 |
| 3,642,187 | 2/1972 | Barland | 227/90 |
| 3,664,564 | 5/1972 | Stanton et al. | 227/7 |
| 3,848,790 | 11/1974 | Verwey et al. | 227/90 |
| 4,318,555 | 3/1982 | Adamski et al. | 227/88 |
| 4,356,947 | 11/1982 | Marshall et al. | 227/5 |

*Primary Examiner*—Peter Vo
*Assistant Examiner*—Jim Calve
*Attorney, Agent, or Firm*—Lawrence P. Kessler

[57] ABSTRACT

A staple wire cutting element (4) is mounted displaceably on a stapling device (1) in which staple wire segments are shaped into a staple and driven into a sheet stack. A control lever (8) that is in engagement with a radial cam unit (6) engages the cutting element (4). The radial cam unit (6) is driven via an overrunning clutch (10), one end of which has a gear (11) which is fixed to the radial cam unit (6) and engages into a gear (5*b*) of a stepping motor (5). The other end of the overrunning clutch (10) has a gear (12) which is fixed to a transport wheel (13) for staple wire transport. A gear (27), which is mounted displaceably along its rotation axis and is mounted rotatably about the same rotation axis as the gear (5*a*), engages into the gear (12). The gears (5*b*, 27) are equipped at their sides facing one another with tooth sets (28). For backward transport of the wire segment which is ready for staple shaping, the displaceable gear (27) is brought into engagement with the gear (5*b*), thus allowing the wire to be transported backward, bypassing the overrunning clutch (10).

4 Claims, 2 Drawing Sheets

STAPLING DEVICE

CROSS-REFERENCE TO RELATED APPLICATIONS

This is a continuation-in-part of application Ser. No. 09/044,191, filed Mar. 19, 1998, entitled "Stapling Device," by Heinz-Guenter Bethmann, Helmut Bloser and Juergen Ries.

BACKGROUND OF THE INVENTION

The invention relates to a stapling device for stapling a stack of sheets by means of staples that are cut off from a staple wire supply and shaped in the stapling head region, the stapling device comprising a staple wire transport device which transports the staple wire a corresponding length as a function of the thickness of a sheet stack to be stapled, and further comprising a movable staple wire cutting element which positions the staple wire, as a function of the thickness of the sheet stack to be stapled, centrally with respect to a staple shaping element on the stapling head, in which:

the staple wire transport device can be driven by a stepping motor whose drive direction is reversible and which can be activated by a measuring device which determines the thickness of the stack to be stapled;

the stepping motor is coupled to the staple wire transport device by means of a coupling that is effective only in the staple wire transport direction;

the stepping motor is continuously coupled to a movable peripheral cam or radial cam unit which controls a displacement of the staple wire cutting element; and the peripheral cam or radial cam unit has control segments which are associated with different sheet stack thicknesses, as defined by U.S. Ser. No. 09/044,191.

In the case of the stapling device as defined in U.S. Ser. No. 09/044,191, the staple wire is transported by a pair of transport rollers, of which one transport roller is driven. A radial cam unit, joined to the driven transport roller, is coupled to a staple wire cutting element in such a way that the radial cam unit can be moved back and forth. In order to allow the staple wire to be transported continuously forward, an overrunning clutch is interposed, which allows reversal of the rotation direction of the drive in order to move the radial cam unit back without changing the transport direction of the staple wire. With this device, however, it is not possible for the staple wire that has already been transported and is ready for staple shaping to be pulled back again, so that, for example, in the event of a malfunction, the staple wire can be transported back into its starting position.

SUMMARY OF THE INVENTION

It is the object of the invention to configure the driving element of a stapling device which controls both staple wire transport and a staple wire cutting element in such a way that the staple wire transport direction is reversible.

According to the invention, this object is attained in that:

two gears, mounted rotatably about a common axis of rotation, are joined to one another via an overrunning clutch;

the one gear is rigidly joined to the peripheral cam and/or radial cam unit, and is in engagement with a stationary gear of a stepping motor;

the other gear is rigidly joined to a staple wire transport wheel and is in engagement with a gear which is mounted displaceably axially with respect to the stationary gear; and the displaceable gear can be brought into positive engagement with the stationary gear.

In an advantageous embodiment of the invention, a pressure spring engages on the displaceable gear, said spring being braced against the stationary gear, the two gears being equipped with opposing spur tooth sets which can be brought into engagement with one another by movement of the displaceable gear. Displacement of the movable gear is accomplished by means of a reciprocating magnet which brings the spur tooth sets of the gears into engagement so that the staple wire transport roller, bypassing the overrunning clutch, can be driven directly by the stepping motor opposite to the actual transport direction.

BRIEF DESCRIPTION OF THE DRAWINGS

Further features and advantages are evident from the description of an embodiment of the invention depicted in the drawings, and from the claims.

DETAILED DESCRIPTION OF THE INVENTION

The device according to the invention for transporting and positioning a staple wire segment is part of a commercially available stapling device 1 (not described further) for shaping and driving staples into a sheet stack.

The subject matter of the invention concerns the particular configuration of a device for reverse transport of a staple wire in a stapling device as defined in U.S. Ser. No. 09/044,191.

Stapling device 1 has, in the usual manner, a stapling head 2 on which a staple shaping and driving element 3, the construction and operation of which are not subjects of the invention and therefore will not be described in more detail, is movably arranged.

Figure 1:
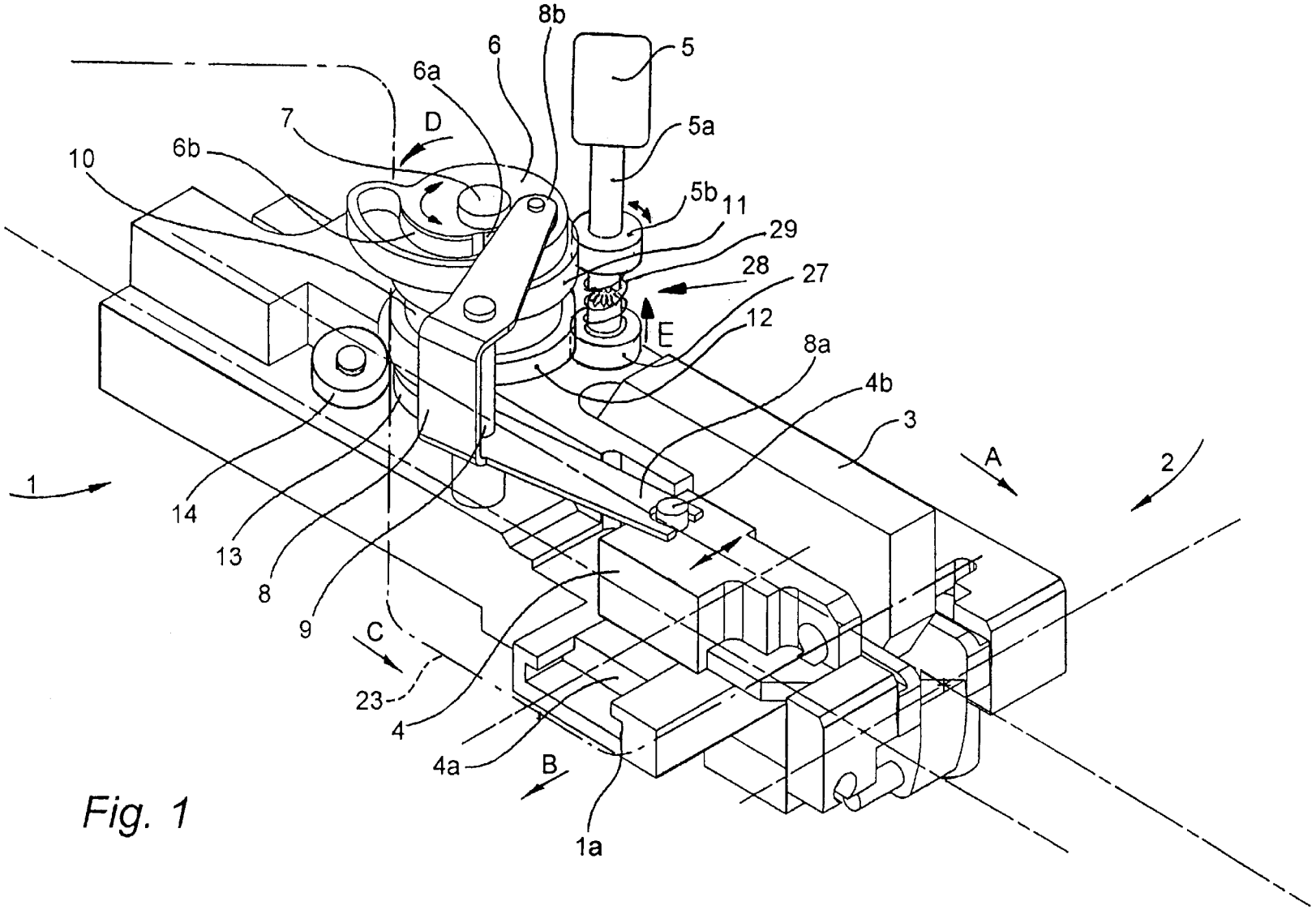
FIG. 1 shows the device in an oblique view, omitting the staple wire guide means.

Arranged in the region of stapling head 2 is a staple wire cutting element 4 which is guided displaceably in the direction of the arrow "B" perpendicular to driving-in direction "A." For this purpose, stapling device 1 and cutting element 4 are equipped with V-guides 1*a* and 4*a*, visible in FIG. 1, for positive guidance of cutting element 4. Arranged on cutting element 4 is a cutting knife 15, 24 having wedge-shaped edges, depicted schematically in FIG. 2, the movably guided cutting blade 15 of which can be moved perpendicular to the staple wire by a driving element (not depicted) of stapling device 1. The wedge-shaped edges of cutting knife 15 and 24 cut off the staple wire in such a way that the wire ends have wedge-shaped points so that they can penetrate more easily into the sheet stack.

A fork-shaped end 8*a* of a first arm of a control lever 8, which is mounted pivotally about a stationary bearing 9, engages positively on a projection 4*b* of cutting element 4. A projection arranged at end 8*b* of a second arm of control lever 8 engages positively into a radial cam 6*a* or 6*b* of a radial cam unit 6.

Radial cam unit 6 is mounted rotatably about a stationary shaft 7. An overrunning clutch 10, one end of which is configured as a gear 11 that is immovably joined to radial cam unit 6, is rotatably mounted on shaft 7. A gear 5*b*, which is attached on motor shaft 5*a* of a stepping motor 5 mounted on stapling device 1, engages into gear 11 of overrunning clutch 10.

The other end of overrunning clutch 10 is configured as gear 12 which is immovably joined to a transport wheel 13 mounted rotatably on shaft 7. Gear 11 and gear 12 of overrunning clutch 10 are coupled to one another via a catch (not depicted) of a known type, the effect of which is that transport wheel 13 can be driven by stepping motor 5 only in rotation direction of "D" or in the staple wire transport direction "C."

Engaging into gear 12 is a gear 27, mounted in known fashion (not depicted) displaceably in the direction of the arrow "E" along its rotation axis and continuously in engagement with gear 12, which is mounted rotatably about the same rotation axis as gear 5*a*. Gears 5*a* and 27 are equipped with tooth sets 28, shown in FIG. 1, facing one another. A preloaded pressure spring 29, which holds tooth sets 28 out of engagement, is arranged between gears 5*a* and 27. Displacement of gear 27 against the force of pressure spring 29 is accomplished, in a manner not depicted, by means of a reciprocating magnet 30 which moves an angled lever 32 engaging on gear 27.

Radial cam unit 6 has a first cam segment 6*a,* arranged concentrically with the rotation axis of shaft 7, that is associated with a constant minimum wire segment length that is provided for a sheet stack thickness of, for example, two sheets.

Adjoining first cam segment 6*a* is a second cam segment 6*b* with a rising cam profile, which is associated with greater wire segment lengths that are provided for a sheet stack thickness of, for example, three sheets up to 10 mm. The position of cam segment 6*a* or of the respective region of cam segment 6*b* with respect to end 8*b* of control lever 8 which engages against the latter is determined in accordance with a measuring device (not depicted). The measuring device controls stepping motor 5, which rotates radial cam unit 6 and transport wheel 13 in the direction of the arrow "D" by an amount corresponding to the requisite length of the wire segment.

The measuring device (not depicted) can be a sensor which scans the stack thickness, or can be formed by a sheet counting device, optionally in conjunction with a prior input of the paper weight.

Rotation of radial cam unit 6 in the direction of the arrow "D" causes, in the rising portion of cam segment 6*b,* a displacement of cutting element 4 in the direction of the arrow "B," specifically in accordance with the determined thickness of the sheet stack being stapled.

A pressure roller 14, which is rotatably mounted on a pivotable arm 16, rests in spring-loaded fashion against transport wheel 13. Engaging against arm 16 is an actuator 18, pivotable about a bearing 17, which is movable by means of a sheathed cable 19 in such a way that pressure roller 14 can be lifted away from transport roller 13 in order to thread in the leading end of the staple wire.

Figure 2:
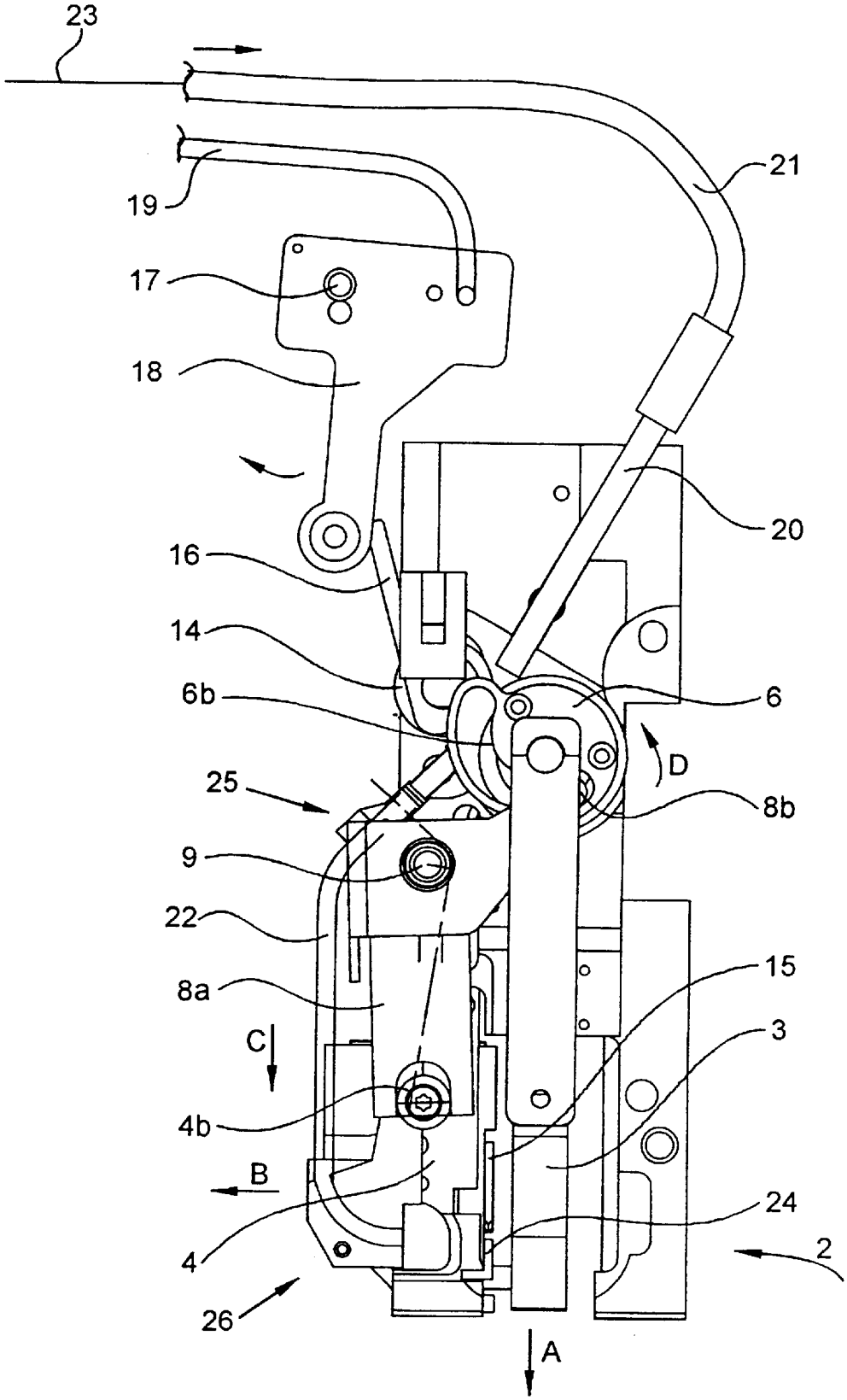
FIG. 2 shows the device of FIG. 1, in a plan view with the staple wire guide means.

Staple wire 23 (indicated with dot-dash lines in FIG. 1), which is guided from a supply roll (not depicted) via a flexible guide tube 21 to stapling device 1, passes through an inlet tube 20, depicted in FIG. 2 and attached on the stapling device, that opens into the inlet gap of pressure roller 14 and transport wheel 13 which effects wire transport. After leaving transport wheel 13 and pressure roller 14, the leading end of the wire actuates a switch 25 (not depicted in further detail) which signals to the user that the staple wire has arrived at stapling device 1. Up to this position, the staple wire is transported by means of a threading-in device (not depicted). From this position on, staple wire 23 is then transported by transport wheel 13, driven by stepping motor 5, through a feed-in tube 22 to a cutting position on cutting element 4.

The device for transporting and positioning a staple wire segment operates as follows:

Operation of stapling device 1, and driving of stepping motor 5, are accomplished by means of a control device (not depicted) of known type which ensures correct operation.

The stapling device is designed such that the thickness of each individual sheet stack is measured, and the suitable length of the staple wire segment for the staple is determined in accordance therewith. This feature makes it possible to staple sheet stacks of different thicknesses in immediate succession without interruption. It is also possible, however, to pull back a staple wire that has already been transported and is ready for staple shaping.

Before each stapling cycle, radial cam unit 6 assumes a starting position that is defined by a sensor, associated with the starting position, that can be, for example, a stationary photoelectric barrier into which a lug (not depicted), arranged on radial cam unit 6, protrudes.

As already mentioned, when radial cam unit 6 as depicted in FIGS. 1 and 2 is in the starting position, the concentric cam segment 6*a* is effective. Control lever 8, resting with the one end 8*b* against cam segment 6*a,* by means of its other end 8*a* also positions cutting element 4 in a starting position which is associated with the minimum wire segment length.

The starting position of cutting element 4 and of cutting knife 15, 24 is defined such that a wire segment to be cut off is positioned centrally with respect to shaper and driver 3 of stapling head 2. The starting position of cutting element 4 can be adjusted by means of projection 4*b* which is configured as an eccentric (not depicted).

When stepping motor 5 is then set in motion, it rotates radial cam unit 6 in the direction of the arrow "D," thereby also, by means of over-running clutch 10 which acts in this rotation direction as a follower clutch, entraining transport wheel 13 in the direction of the arrow "D."

If the leading end of the wire has not yet assumed its starting position in the cutting position, which the aforementioned control device determines by the fact that switch 26 on cutting element 4 has not yet been actuated, the staple wire transport operation necessary for that purpose is then first performed. To this end, stepping motor 5 rotates radial cam unit 6 in the direction of the arrow "D" only as far as concentric cam segment 6*a* extends, so that although staple wire transport in the direction of the arrow "C" takes place, cutting element 4 maintains its starting position. This staple wire transport action takes place, by means of alternating changes in the rotation direction of stepping motor 5, until the leading end of the wire actuates said switch 26.

The control circuit then triggers a defined number of switching steps of stepping motor 5, which, as already mentioned, brings the leading end of the wire into the cutting position and thus into the starting position. These latter switching steps also occur, in the manner described above, within the rotation range of radial cam unit 6 delimited by concentric cam segment 6*a*.

The normal stapling cycle can now begin, by the fact that the stepping motor is set in motion. If the stack thickness being stapled consists of only two sheets, stepping motor 5 is then driven by a control device of a known type (not depicted), governed by the measuring device determining the sheet stack thickness, in such a way that it rotates radial cam unit 6 only to the end of concentric cam segment 6*a*. Control lever 8 is not moved during this movement of concentric cam segment 6*a,* so that cutting element 4 with cutting knife 15, 24 also remains in the starting position.

During the rotation of radial cam unit 6 over the length of the first concentric cam segment 6*a* in the direction of the arrow "D," the staple wire is transported by means of transport wheel 13 over a length that is necessary to form a staple for stapling two sheets together.

Once wire transport has occurred, stepping motor 5 is halted and the wire segment is cut off. For this, movable cutting blade 15 is moved toward stationary cutting blade 24 by drive means (not depicted) of stapling device 1, the movement being controlled so that the edges do not strike one another.

The cut-off wire segment is then shaped into a staple, in a known manner (not depicted), by shaper and driver 3, and driven in the direction of the arrow "A" into the sheet stack being stapled (not depicted). The staple ends emerging from the sheet stack are bent over, again in known fashion (not depicted) and laid against the reverse side of the sheet stack.

When a sheet stack consisting of more than two sheets is to be stapled, the aforesaid measuring device then determines the corresponding thickness and controls stepping motor 5, which rotates radial cam unit 6 a correspondingly greater distance in the direction of the arrow "D," as a function of that value.

In this context, the one end 8*b* of control lever 8 slides up against rising cam segment 6*b,* causing control lever 8 to pivot clockwise. This clockwise pivoting causes a movement in the direction of the arrow "B" of cutting element 4 and of cutting knife 15, 24 arranged thereon, specifically by an amount which equals half the increase in wire segment length as compared with the minimum wire length associated with the starting position.

As radial cam unit 6 simultaneously rotates in the direction of the arrow "D," transport wheel 13 transports staple wire 23. The length of the transported staple wire corresponds to the minimum wire length described above, plus half the increase in wire length required by the measured sheet stack thickness.

Because cutting element 4 and cutting knife 15, 24 have been moved in the direction of the arrow "B" by half the increase in wire segment length, and the wire has been transported in the direction of the arrow "C" by half the increase in wire segment length, the now-longer wire segment is also positioned centrally with respect to shaper and driver 3 of stapling head 2.

Between the stapling cycles, the device is moved back into its starting position by the fact that stepping motor 5 is driven in the opposite rotation direction and radial cam unit 6 is thereby moved back opposite to the direction of the arrow "D" into the position depicted in FIGS. 1 and 2. During this backward movement of radial cam unit 6, overrunning clutch 10 causes transport wheel 13 not to be driven, so that the staple wire does not change its position and is thereby ready in operationally correct fashion for the next transport cycle.

All other wire segment lengths that are determined by rotation of radial cam unit 6 within second cam segment 6*b* with the rising cam profile, as governed by the measuring device which determines the thickness of the sheet stack being stapled, are transported and positioned in the same manner as described above.

Since the staple length can be matched, in the manner described above, to the particular sheet stack thickness, perfect and reliable staple joins are achieved.

If the stapling device is halted during the operating sequence, for example in order to clear a paper jam, it may happen that the staple wire has already been transported and is ready for staple forming in stapling head 2. When the stapling device is then started up, the control device assumes that a new stapling cycle is beginning, and transports the wire length associated with the measured stack thickness, even though a corresponding wire segment is already ready. As a result, much too long a wire segment would be made available in such a case; this would lead to a malfunction of stapling device 1. A situation of this kind can also occur if, after a malfunction, the wire segment that has been made available no longer corresponds to the stack thickness being stapled.

In order to rule out such malfunctions, the staple wire is, in such a case, transported back into a starting position before restarting.

In this case, when stapling device 1 is started up again, its control device first activates the reciprocating magnet, which moves movable gear 27 upward in the direction of the arrow "E" against the force of spring 29, so that its teeth 28 come into engagement. Transport wheel 13 is then driven directly via stepping motor 5 opposite to the direction of the arrow "D," bypassing the locking effect of over-running clutch 10, and the staple wire is transported back until switch 26 detects its starting position and backward transport is stopped. This backward movement takes place within the rotation range of co-rotating radial cam unit 6, which is thus also returned to its starting position. From this starting position, the normal operating sequence described above can then occur correctly.

In a variation from tooth set 28 described above, positive coupling of gears 5*b* and 27 can also be accomplished by means of another suitable coupling, for example, a claw coupling of known type (not depicted).

In a variation from the embodiment described, it is also possible to utilize, instead of rotatably mounted radial cam unit 6, a displaceably guided peripheral cam unit (not depicted) which has a first control segment running parallel to the displacement direction, and a second control segment adjacent thereto and configured as a rising ramp. End 8*b* of control lever 8, equipped with a projection, rests against the control segments of this peripheral cam unit (not depicted) that is displaceably guided on stapling device 1, while this peripheral cam unit is moved, via a tooth set arranged parallel to the displacement direction, by the correspondingly adapted over-running clutch 10 and stepping motor 5, 5*b.* Staple wire transport and control of cutting element 4 are accomplished as described above with reference to FIGS. 1 and 2.

It is to be understood that various other changes and modifications may be made without departing from the scope of the present invention, the present invention being limited by the following claims.

What is claimed is:

1. Stapling device for stapling a stack of sheets by staples that are cut off from a staple wire supply and shaped in the stapling head region, said stapling device comprising:

a staple wire transport device which transports staple wire a corresponding length as a function of the thickness of a sheet stack to be stapled;

a movable staple wire cutting element which positions staple wire, as a function of the thickness of the sheet stack to be stapled, centrally with respect to a staple shaping element on the stapling head;

said staple wire transport device driven by a stepping motor whose drive direction is reversible and which is activated by a measuring device which determines the thickness of the stack to be stapled;

said stepping motor coupled to said staple wire transport device by a coupling that is effective only in a staple wire transport direction;

said stepping motor continuously coupled to a movable cam unit which controls a displacement of said staple wire cutting element; and said cam unit includes control segments which are associated with different sheet stack thicknesses, said cam unit being rotatably mounted on a shaft and having two gears, mounted rotatably about said shaft and joined to one another via an overrunning clutch, one gear of said two gears being rigidly joined to said cam unit, and in engagement with a non-axially displaceable gear of said stepping motor, the other gear of said two gears being rigidly joined to a staple wire transport wheel and in engagement with a gear which is mounted displaceably axially with respect to said non-axially displaceable gear, and said axially displaceable gear being selectively brought into positive engagement with said non-axially displaceable gear.

2. Stapling device as defined in claim 1, wherein said gears are equipped with a non-axially displaceable and said axially displaceable gear set on their sides facing one another.

3. Stapling device as defined in claim 1, wherein a preloaded pressure spring is arranged between said non-axially displaceable and said axially displaceable gears.

4. Stapling device as defined in claim 1, wherein said displaceable gear is movable by an angled lever joined to a reciprocating magnet and engaging on said gear.

* * * * *